US011098466B1

(12) United States Patent
Faison

(10) Patent No.: US 11,098,466 B1
(45) Date of Patent: Aug. 24, 2021

(54) FLEXIBLE AND RIGID FAUCET

(71) Applicant: Vann Stone Faison, Seattle, WA (US)

(72) Inventor: Vann Stone Faison, Seattle, WA (US)

( * ) Notice: Subject to any disclaimer, the term of this patent is extended or adjusted under 35 U.S.C. 154(b) by 0 days.

(21) Appl. No.: 17/022,087

(22) Filed: Sep. 16, 2020

Related U.S. Application Data

(63) Continuation of application No. 16/946,125, filed on Jun. 7, 2020, now abandoned.

(51) Int. Cl.
*E03C 1/04* (2006.01)
*E03C 1/05* (2006.01)

(52) U.S. Cl.
CPC ..... *E03C 1/0404* (2013.01); *E03C 1/05* (2013.01); *E03C 2001/0414* (2013.01)

(58) Field of Classification Search
CPC ..... E03C 1/0404
USPC ..... 4/678, 675, 567
See application file for complete search history.

(56) References Cited

U.S. PATENT DOCUMENTS 5,720,055 A * 2/1998 Krist ..... D06F 41/00 4/255.06
6,123,106 A * 9/2000 Benstead ..... E03C 1/0401 137/343
7,494,074 B2 * 2/2009 Benstead ..... B05B 1/1618 239/11
7,871,020 B2 * 1/2011 Nelson ..... E03C 1/0404 239/445
2007/0170284 A1 * 7/2007 Nelson ..... E03C 1/0404 239/443
2014/0026980 A1 * 1/2014 Esche ..... B05B 1/185 137/315.01

* cited by examiner

*Primary Examiner* — Lori L Baker

(57) ABSTRACT

A flexible and locking faucet has a body, base and spray head. The body connects the base to a spray head. The body includes a frame and a fluid supply line. The fluid supply line changes shape due to the internal fluid pressure change. The fluid supply line's change of shape allows the frame to become flexible or locked. The spray head is connected to the body and may be maneuvered and positioned depending the state of the body.

19 Claims, 4 Drawing Sheets

FLEXIBLE AND RIGID FAUCET

The subject matter this case is hereby amended and referenced as Amendment C, submitted Jun. 27, 1921 to application Ser. No. 17/022,087.

TECHNICAL FIELD

The present disclosure relates generally to the field of faucets. This disclosure more specifically relates to a faucet that can change between a flexible and rigid state.

BACKGROUND

The intended purpose of this section is to provide context to the invention that is stated in the claims. The description herein may include concepts that have the ability to be performed, but have not necessarily been previously performed or conceptualized.

For a user to be able to position a faucet to a desired location, a faucet often swivels or pivots from a fixed point. This limits the locations to access a faucet.

In another example, for a user to spray water freely, a faucet often comprises of a rigid body of which contains an internal flexible spray hose. This hose can be pulled out from the fixed body. The fixed location of the faucet is dependent on the location of the fixed body, and the spray locations will always begin and end at the terminus of the fixed body location.

In another example, the faucet spray head may be able to achieve different spray locations due to a flexible faucet body but will return to the same predetermined position once the user finishes spraying.

In all examples, although the spray heads allow the user to direct the the water from the spray head in a flexible fashion, and while they have a fixed position, the flexible spray head can only become fixed at the location of the fixed body. This can create hindrances in the use of the sink due to a limited amount of possibilities in rigid and flexible positioning.

There is a need for a new technology that may fix the shortcomings mentioned above.

SUMMARY

One exemplary embodiment of the disclosure relates to a flexible and locking faucet that uses pressure to lock itself into a fixed position. The basic structure may comprise a base that connects the faucet to a surface, a spray head that directs the spray of fluid exiting the faucet and a faucet body connecting the spray head to the base. The faucet body includes an internal fluid tube that locks the faucet as a function of a change in the faucet pressure.

The faucet body is capable of being used as a flexible spray device under one pressure condition. With a change in pressure condition, the faucet body becomes rigid and secures the direction of the fluid sprayed to allow for a hands-free operation. Alterations in pressure can result in different outcomes. A further change in pressure can allow the faucet to remain rigid while not spraying fluid. Another change in pressure can allow the faucet to return to a flexible faucet to be repositioned yet again. The repositioning can occur in a state that sprays fluid, or in a state that does not spray fluid.

Further embodiments and advantages of this current disclosure may be achievable due to the consideration of these Claims, this Detailed Description and these Drawings. It should be understood that this Summary and the Detailed Description of the current disclosure are intended to be exemplary and are meant to further explain while not limiting the scope of the current disclosure.

BRIEF DESCRIPTION OF DRAWINGS

The drawings are intended to provide a further understanding of the invention. They resemble a part of this specification and illustrate the underlying principles of the disclosed embodiments

DETAILED DESCRIPTION

Prior to referencing the figures, it should be understood that all features related to particular embodiments, in the Summary above, this Detailed Description, and the Claims below, and in the accompanying Drawings can be used with other features to the extent possible. It should be understood that the current disclosure is not limited by the detail description or illustrations. Additionally, it should be understood that the terminology used is solely for the purpose of description and should not be inferred as limiting.

Generally, all illustrative embodiments of the disclosure relate to a flexible and locking faucet including the mounting surface, spray head, body and base. The base is mounted to the mounting surface, the body is connected to the base, the spray head is connected to the body. Some examples of some mounting surfaces are a wall, counter, table, sink, cabinet, vanity, appliance etc. The body can be reconfigured to several positions and can maintain a flexible or rigid state. The spray head can spray water or not spray water at either of the flexible or rigid states. The flexible and locking body is cable of acquiring whatever shape the user puts it in and maintaining that position with a pressure adjustment.

Figure 1:
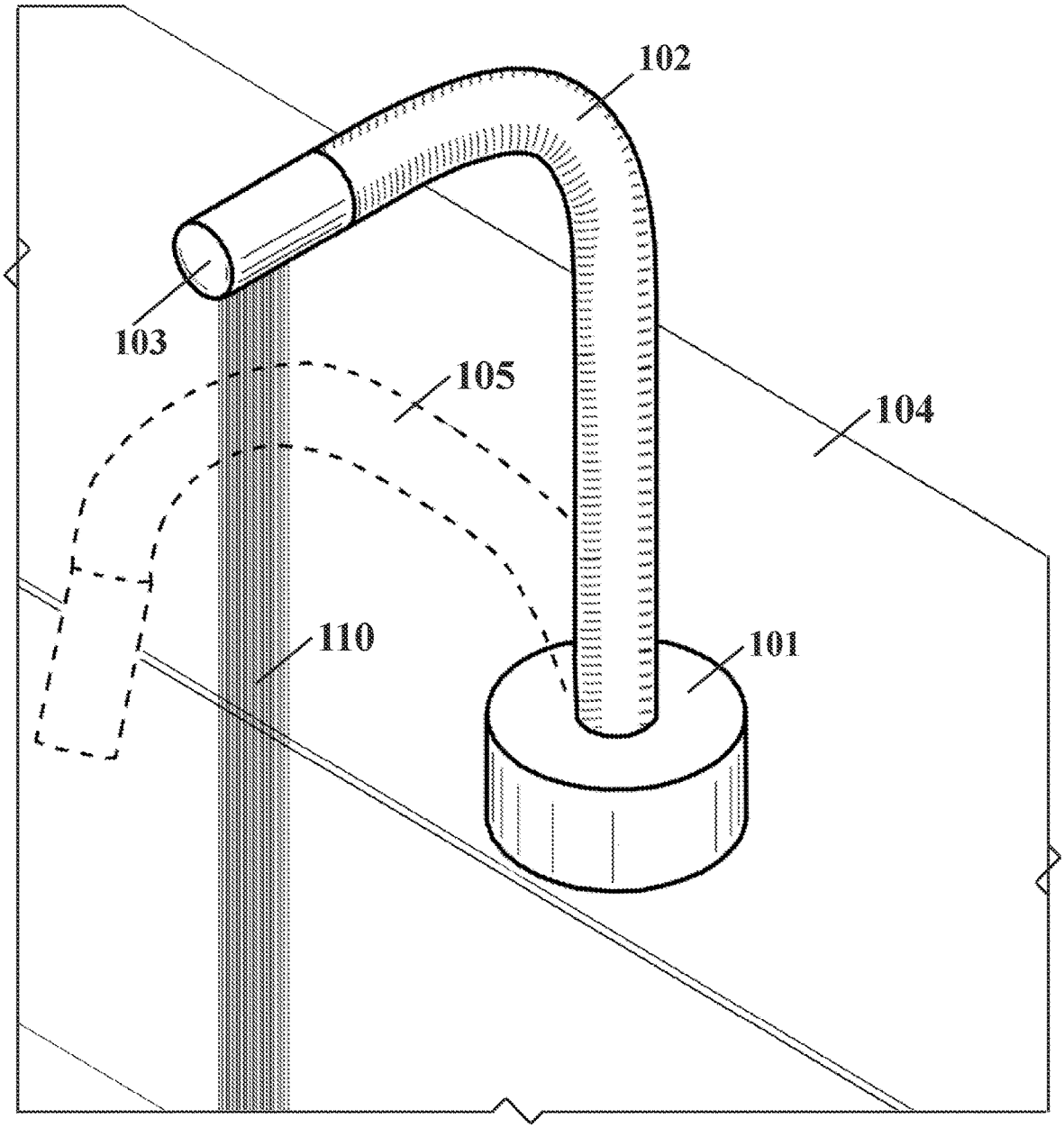
FIG. 1 is a labeled perspective view of an exemplary embodiment of the flexible and locking faucet.

More specifically, as illustrated in FIG. 1, a flexible and locking faucet includes a base 101, a faucet body 102, and a spray head 103. The base 101, is mounted to the surface 104. Surface 104 is representing a mounting surface. This mounting surface may be a wall, counter, table, sink, cabinet, vanity, appliance etc. The mounting surface is not limited to these possibilities. The faucet body 102 may be moved to a user chosen locations. See location 105 for a potential user chosen location. These locations are exemplary and do not represent the totality and variety of potential locations for the faucet body to be positioned. The spray head 103, is configured to spray water 110, in the position chosen by the user. A faucet position illustrated by the placement of the spray head 103, faucet body 102 and base 101 may be indicative of a chosen location for the faucet to become fixed when the user adjusts the pressure at the base 101, or at the spray head 103.

Figure 2:
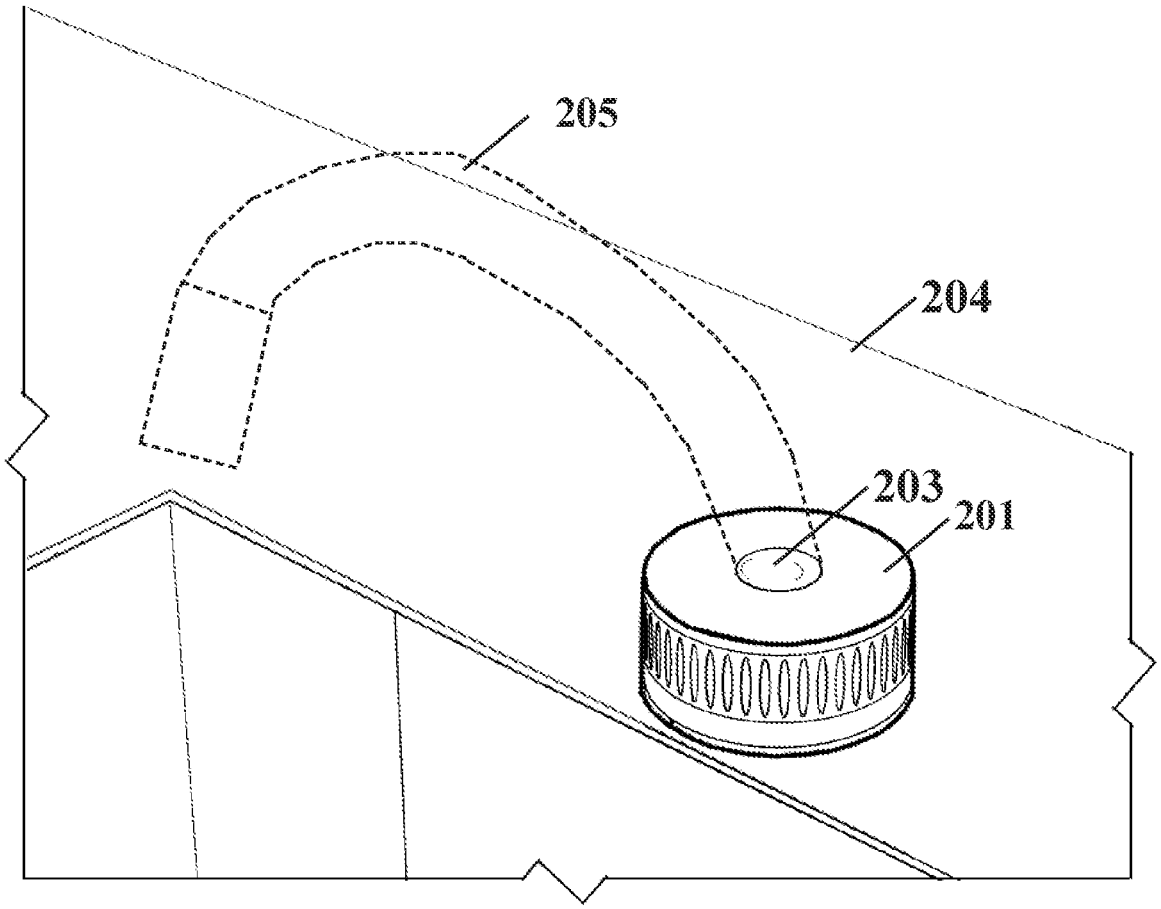
FIG. 2 is a labeled perspective view of an exemplary embodiment of the flexible and locking faucet.

As illustrated in FIG. 2, the faucet in a user defined position 205 may retract through the base 201. The spray head 203, may become fixed at the base 201. Base 201 may be fastened to the surface 204.

Figure 3:
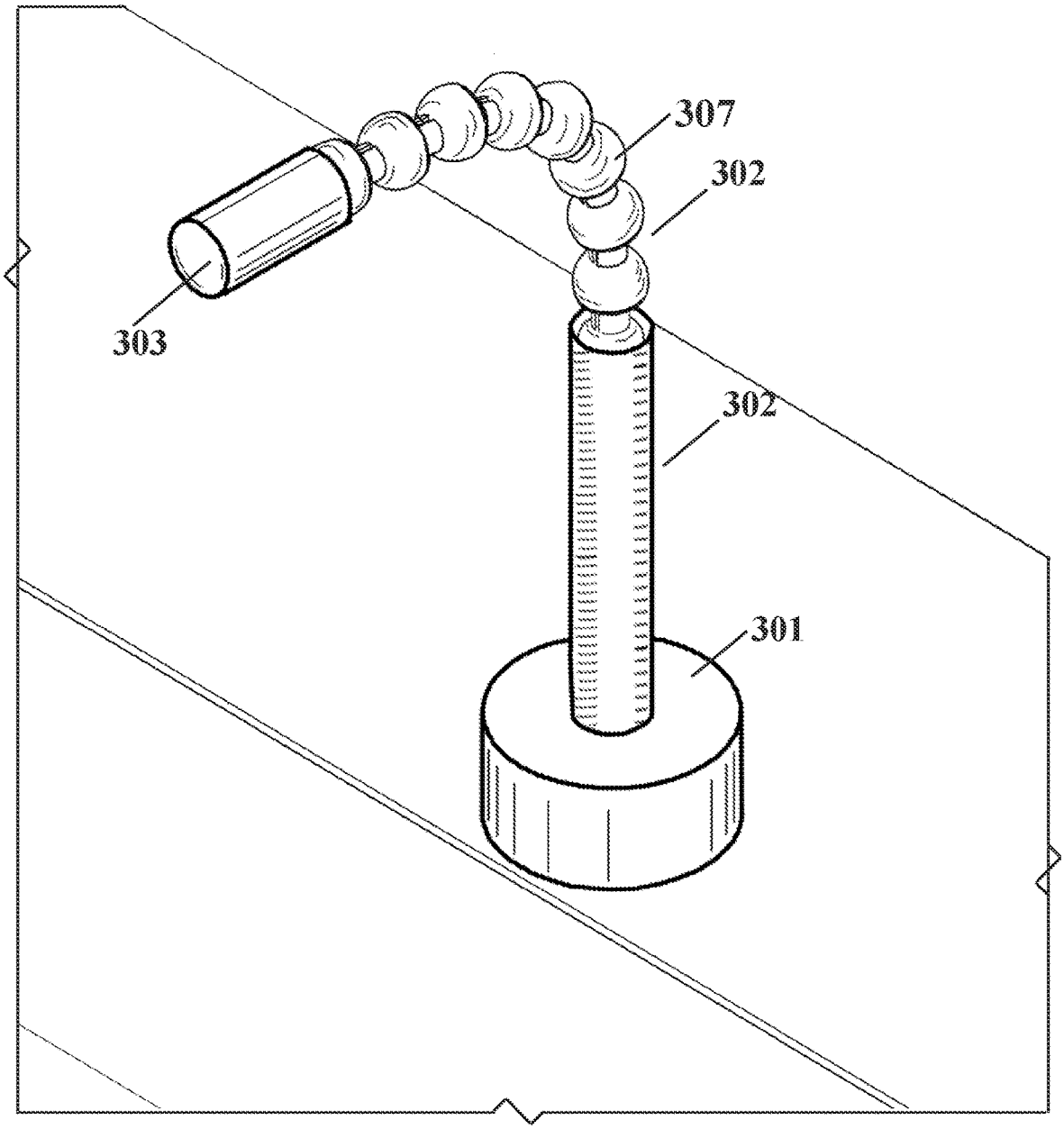
FIG. 3 is a labeled perspective view of an exemplary embodiment of the flexible and locking faucet.

As illustrated in FIG. 3, a flexible and locking faucet includes base 301, a faucet body 302, and a spray head 303. The faucet body 302 has one or more locking mechanisms

307. With the increase or decrease of water exiting spray head 303, the faucet body 302 may become fixed in position. The faucet body 302 may otherwise remain flexible or become rigid while the water does not exit spray head 303. With the reduction or elimination of water exiting spray head 303, the faucet body 302 may remain flexible. The faucet body 302 may otherwise become fixed in position while the water does not exit spray head 303. The faucet may achieve flexibility or a fixed position with different variations of pressure increase and decrease.

Figure 4:
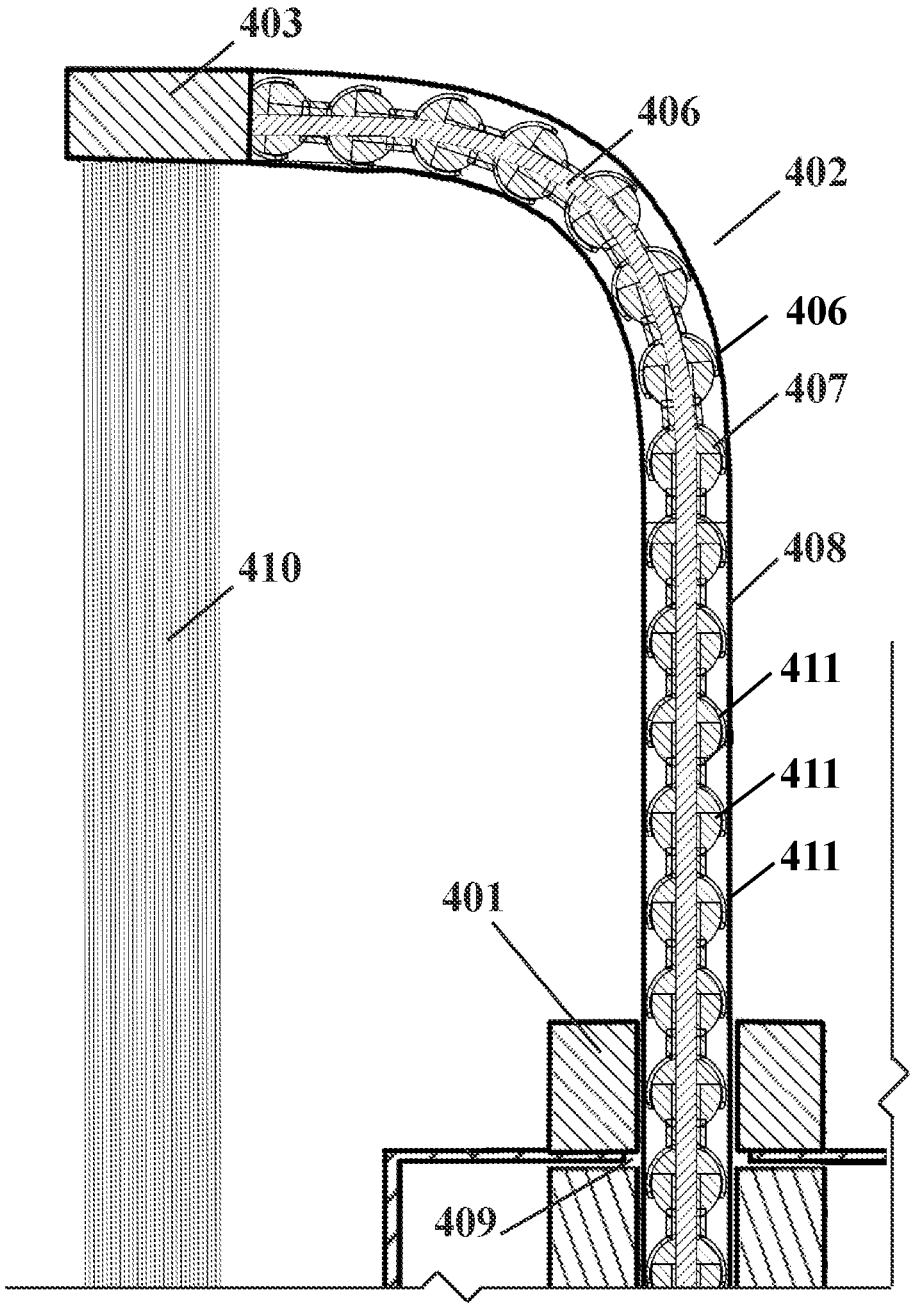
FIG. 4 is a labeled section view of an exemplary embodiment of the flexible and locking faucet.

As illustrated in FIG. 4, a flexible and locking faucet has a body 402 comprises of an internal internal fluid tube 406. The internal fluid tube 406 may expand or contract within the locking mechanism 407 due to fluid pressure adjustment. The fluid pressure adjustment may be made by releasing fluid 410 from the faucet. The internal fluid tube 406 may be made of a variety of materials including silicone and polyurethane, but not limited to silicone and polyurethane. When the internal fluid tube 406 expands, the locking mechanism 407 may lock in place. The locking mechanism 407 may be made from a variety of materials, including but not limited to polylactic acid, acrylonitrile butadiene styrene, polycarbonate plastic, aluminum and polyamide. Once the internal fluid tube 406 contracts to a certain size, it may relieve pressure on the locking mechanism 407. Visual sleeve 408 may encompass the body assembly. A variety of colors, and textures may be applied to each of the faucet components for aesthetic and tactile purposes. The faucet body 402 may pass through the base 401 and through mounting hole 409. The Spray head 403 may pass through the base 401 and through the mounting hole 409.

Additionally, FIG. 4 may comprise of a base 401, body 402, and spray head 403. The base 401 is mounted to a mounting surface 404 and is connected to the body 402. The body 402 is connected to the spray head 403. The body includes a locking mechanism 411 and a fluid supply line 406. The fluid supply line 406 changes shape due to an internal fluid pressure change. The fluid supply line's change of shape allows the locking mechanism 411 to become flexible or locked due to pressure imposed on the locking mechanism 411 from the fluid supply line 406.

The invention claimed is:

1. A faucet comprising;

a spray head to direct the spray of fluid exiting said faucet; and a body to position said spray head, said body to change from a flexible state to a rigid state, whereby said body locks said spray head into a user defined position by an internal fluid tube expansion or contraction, or said body to change from a rigid state in said user defined position to a flexible state, whereby said body unlocks said spray head from said user defined position by an internal fluid tube expansion or contraction, whereby said faucet is capable of being used as a flexible spray device in said flexible state.

2. The faucet of claim 1 further including said internal fluid tube to expand or contract, whereby said internal fluid tube locks said body in position due to a fluid pressure imposed on the body.

3. The faucet of claim 1 wherein said body contains at least one locking mechanisms, whereby said locking mechanisms lock said body in position.

4. The faucet of claim 1, wherein said body locks said spray head in position due to pressure adjustment of one or more internal fluid tube.

5. The faucet of claim 1, wherein said faucet comprises of a locking mechanism to lock said spray head into a user defined position by a variation in fluid pressure.

6. The faucet of claim 1, wherein said body contains said body with a locking mechanism whereby said locking mechanism adjusts said faucet flexible or rigid state.

7. The faucet of claim 1, wherein said faucet contains;

a base for mounting said faucet to a mounting surface, whereby said base connects to said body and said body connects to said spray head; and a visual sleeve for encompassing said body; and a locking mechanism for locking said body in position.

8. A faucet comprising;

a body to position said faucet; and a spray head to direct a fluid exiting said faucet; and a locking mechanism to lock or unlock said faucet to a user given shape, whereby said locking mechanism lock results in a flexible or a rigid faucet.

9. The faucet of claim 8, wherein said faucet is mounted to a mounting surface.

10. The faucet of claim 8, wherein said locking mechanism is located at a base of said faucet.

11. The faucet of claim 8, wherein said locking mechanism is located at said spray head of said faucet.

12. The faucet of claim 8, wherein said locking mechanism is located at said body of said faucet.

13. A faucet for changing said faucet from a flexible to a rigid state, comprising;

a body for positioning said faucet to a predetermined shape; and an internal fluid tube for locking in position said body, whereby said faucet changes from said flexible state to said rigid state with an expansion or contraction of said internal fluid tube.

14. The assembly of claim 13, wherein a faucet pressure variation is located at a base of said faucet.

15. The assembly of claim 13, wherein said faucet pressure variation is located at a spray head of said faucet.

16. The assembly of claim 13, wherein said faucet is mounted to a mounting surface.

17. The assembly of claim 13, further including using the faucet in a hands-free operation after said faucet changes to a rigid state.

18. The assembly of claim 13, further including using the faucet as a flexible spray device.

19. The assembly of claim 13, wherein said fluid pressure change expands an internal fluid tube to impose pressure on said body.

* * * * *